US005155988A

United States Patent [19]

Nieratschker

[11] Patent Number: 5,155,988

[45] Date of Patent: Oct. 20, 1992

[54] TWO-FOR-ONE TWISTING SPINDLE

[75] Inventor: Hermann Nieratschker, Gronau-Epe, Fed. Rep. of Germany

[73] Assignee: Palitex Project-Company GmbH, Krefeld, Fed. Rep. of Germany

[21] Appl. No.: 830,598

[22] Filed: Feb. 4, 1992

[30] Foreign Application Priority Data

Feb. 4, 1991 [DE] Fed. Rep. of Germany ..... 4103286

[51] Int. Cl.[5] ..... D01H 7/86; D01H 13/10

[52] U.S. Cl. ..... 57/279; 57/58.86

[58] Field of Search ..... 57/279, 58.7, 58.83, 57/58.84, 58.86

[56] References Cited

U.S. PATENT DOCUMENTS

| | | | |
|---|---|---|---|
| 4,281,508 | 8/1981 | Frentzel-Beyme | 57/279 |
| 4,287,712 | 9/1981 | Franzen | 57/279 |
| 4,468,920 | 9/1984 | Lorenz | 57/279 |

FOREIGN PATENT DOCUMENTS

| | | | |
|---|---|---|---|
| 3243157 | 5/1984 | Fed. Rep. of Germany | 57/279 |

*Primary Examiner*—Joseph J. Hail, III

*Attorney, Agent, or Firm*—Robert W. Becker & Associates

[57] ABSTRACT

A two-for-one twisting spindle for threading a thread by compressed air is comprised of a hollow axle with two cylindrical chambers. A thread storage disk with a thread guiding channel is connected to a lower end of the hollow axle, and a thread inlet tube is connected to the upper end. A thread brake comprising a braking cartridge, an upper and a lower braking ring, and a support is arranged inside the first cylindrical chamber. The braking cartridge, in a braking position, rests with an upper end at the upper and with a lower end at the lower braking ring. In a released position, the braking cartridge rests at the support. The lower braking ring is connected to a hollow piston slidable inside the first cylindrical chamber. A jet of compressed air generates a suction effect in the hollow axle and forces the thread from the thread inlet tube through the thread guiding channel. The hollow piston is axially displaceable by the suction effect, thereby releasing the braking cartridge from the braking position and opening a path for the thread through the braking rings. A tube extending as a downward projection of the lower braking ring and guided within the first cylindrical chamber has a lateral opening for communicating with the first cylindrical chamber. A second hollow piston is connected to the free end of the tube and is slidable inside the second cylindrical chamber.

6 Claims, 3 Drawing Sheets

TWO-FOR-ONE TWISTING SPINDLE

BACKGROUND OF THE INVENTION

The present invention relates to a two-for-one twisting spindle in which a thread is threaded by compressed air.

In a two-for-one twisting spindle the thread is usually removed in an upward direction from a stationary supply spool, is then introduced into the upper end of the thread inlet tube, is guided in a downward direction and thereby fed from the thread guiding tube through the spindle rotor where it exits in a radial direction from the thread guiding channel, respectively, thread outlet channel of the thread storage disk. From this outlet channel, the thread is guided in an upward direction by a balloon rotating about the supply spool. A thread guiding member or a thread guiding eye is commonly the upper limitation of the thread balloon. The thread is then guided via a leading spool to a reciprocating thread guide and from there to a winding spool which in general is driven by a friction roller.

For threading a thread through a spindle, compressed air actuated threading devices are known which are provided in the area of the hollow spindle axle. These threading devices suck the thread into the hollow spindle axle by a suction effect (injector effect) and convey the thread through the thread guiding channel of the thread storage disk with the aid of the jet of compressed air.

In order to operate the threading device it is required that the injector nozzle is provided with compressed air which is fed to the injector nozzle via respective compressed air channels. It is known from the German patent 24 61 796 to guide the compressed air through stationary spindle parts such that the compressed air channel is a component of the stationary spool pot and is guided from the outer circumference of the pot to the injector nozzle. In this embodiment, the compressed air channel has a segment that extends radially through the bottom of the spool part and communicates with a further segment extending through the hollow hub of the spool pot. According to German patents 20 35 025 and 30 12 427 it is also known to arrange the injector nozzle centrally within the thread storage disk whereby the compressed air line, respectively, the compressed air channel is guided centrally through the whorl. In such an embodiment a coupling segment is required in the area of the compressed air line between a stationary and a rotating part.

In a two-for-one twisting spindle of the aforementioned kind the pneumatic threading of a thread through the hollow spindle axle and the thread storage disk requires a free thread passage within the area of a thread brake which is needed for stabilizing the twisting process. This is achieved, for example, when the braking cartridge of a cartridge brake is released from the two braking rings on which the braking cartridge is supported so that both passages through the braking rings are opened.

An arrangement corresponding to the above described embodiment is disclosed in the German patent 28 30 265 (FIGS. 6 and 7). For the given constructive dimensions of a respective thread brake the suction, respectively, vacuum forces generated by the suction effect (injector effect) are relatively small so that the piston, which encloses one of the braking rings and which is displaced by the vacuum forces for releasing the braking cartridge, may be supported at the cylinder walls only with minimal friction forces. In practice, the return elements for returning the piston must be adjusted exactly to the corresponding displacement forces, respectively, the spring force of the cartridge. However, the vacuum forces which may be reached by the injector effect are limited. The return force acting on the piston with the lower braking ring must be great with respect to the cartridge force.

It is therefore an object of the present invention to provide a two-for-one twisting spindle of the aforementioned kind in which the vacuum generated by the suction effect (injector effect) is sufficient to open and close the thread brake in a reliable manner.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
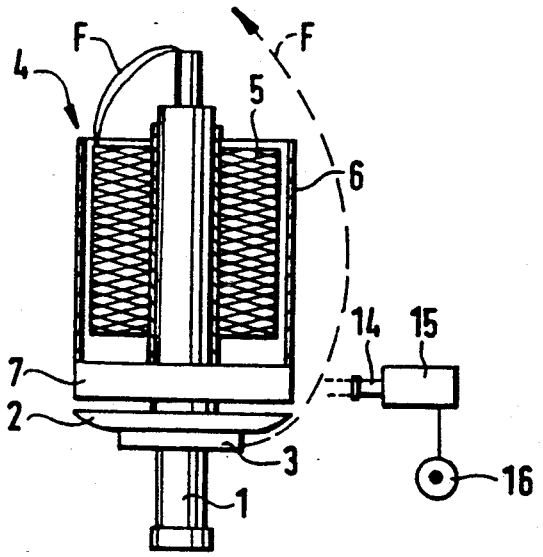
FIG. 1 is a schematic representation of a side view of an inventive two-for-one twisting spindle.

The two-for-one twisting spindle of the present invention is primarily characterized: by a hollow axle comprising at least two cylindrical chambers; a thread storage disk having a thread guiding channel and being connected to a lower end of the hollow axle; a thread inlet tube connected to an upper end of the hollow axle; a thread brake arranged inside a first one of the cylindrical chambers, the thread brake comprising a breaking cartridge, an upper and a lower braking ring, and a support means for supporting the braking cartridge in a released position thereof, the braking cartridge, in a braking position, resting with an upper end at the upper braking ring and with a lower end at the lower braking ring; a hollow piston sealingly slidable inside the first cylindrical chamber, with the lower braking ring being connected to the hollow piston; a means for returning the hollow piston into an initial position; a means for providing a jet of compressed air to the two-for-one twisting spindle, with the jet of compressed air generating a suction effect in the hollow axle and conveying a thread from the thread inlet tube to the thread guiding channel, the thread being forced through the guiding channel by the jet of compressed air, and with the hollow piston being axially displacable by the suction effect against a force of the returning means, thereby releasing the braking cartridge from the braking position and opening a path for the thread through the upper and lower braking rings; and at least one further hollow piston guided in a respective further one of the cylindrical chambers and being coaxial to the lower braking ring, the further hollow piston being actuatable by the jet of compressed air.

When compressed air is fed into the injector nozzle, a vacuum is generated above the injector nozzle which also extends into the space below the lower braking ring so that, since within the cylindrical chamber portion containing the braking cartridge atmospheric pressure is present, the piston comprising the lower braking ring is pulled in the direction towards the injector nozzle due to the pressure difference. After a certain downward displacement of the piston a separation between the braking ring and the braking cartridge takes place. Then surrounding air may flow around the braking cartridge into the space of the braking arrangement On the one hand, the inflowing air serves as desired threading air for pulling along the thread to be threaded, but, on the other hand, it reduces the vacuum forces acting on the piston.

In a preferred embodiment, the two-for-one twisting spindle is comprised of a hollow axle comprising at least two cylindrical chambers; a thread storage disk having a thread guiding channel and being connected to a lower end of the hollow axle; a thread inlet tube connected to an upper end of the hollow axle; a thread brake arranged inside a first one of the cylindrical chambers, the thread brake comprising a braking cartridge, an upper and a lower braking ring, and a support means for supporting the braking cartridge in a released position thereof, the braking cartridge in a braking position resting with an upper end at the upper braking ring and with a lower end at the lower braking ring; a hollow piston sealingly slidable inside the first cylindrical chamber, with the lower braking ring being connected to an upper portion of the hollow piston; a means for returning the hollow piston into an initial position; a means for providing a jet of compressed air to the two-for-one twisting spindle, with the jet of compressed air generating a suction effect in the hollow axle and conveying a thread from the thread inlet tube to the thread guiding channel, the thread being forced through the guiding channel by the jet of compressed air, and with the hollow piston being axially displacable by the suction effect against a force of the returning means, thereby releasing the braking cartridge from the braking position and opening a path for the thread through the upper and lower braking rings; a tube being connected to the hollow piston and extending in a downward direction as an extension of the lower braking ring, the tube having at least one lateral opening for communicating with the first cylindrical chamber and being sealingly guided within a lower face wall of the first cylindrical chamber; and a second hollow piston connected to a free end of the tube and axially sealingly slidable inside a second one of the cylindrical chambers, the second cylindrical chamber having an air inlet in a cylindrical wall thereof arranged between the lower face wall of the first cylindrical chamber and an upper side of the second hollow piston.

In another preferred embodiment, the two-for-one twisting spindle further comprises a second tube connected with one end thereof to a free face of the second hollow piston and sealingly guided in a lower face wall of the second cylindrical chamber, the second tube having at least one lateral channel for communicating with the second cylindrical chamber; and a third hollow piston connected to a further end of the second tube and sealingly slidable within a third one of the cylindrical chambers, the third cylindrical chamber having at least one air vent in a cylindrical wall thereof arranged above the third hollow piston.

It is preferable that the two-for-one twisting spindle further comprises a spindle rotor connected to a top portion of the thread storage disk; a spindle pot having a bottom portion with a hollow hub; an injector nozzle connected to the means for providing the jet of compressed air and being fastened inside the hollow axle above the spindle rotor; and a compressed air channel for connecting the injector nozzle to the means for providing the jet of compressed air, the compressed air channel being comprised of a first segment extending radially through the bottom portion and a second segment extending in an axial direction through the hollow hub.

In a further advantageous embodiment of the two-for-one twisting spindle, an injector nozzle, connected to the means for providing the jet of compressed air, is fastened centrally inside the thread storage disk. The injector nozzle has an opening directed in a direction of extension of the thread guiding channel whereby the thread guiding channel extends radially through the thread storage disk. Furthermore, a whorl is connected to a bottom portion of the thread storage spindle. A compressed air channel for connecting the injector nozzle to the means for providing the jet of compressed air is provided whereby the compressed air channel extends axially through a center of the whorl.

It is expedient that the support means is a ring inserted into the first cylindrical chamber and comprises radially inwardly extending projections. The braking cartridge has a radially outwardly projecting collar for cooperating with the radially inwardly extending projections in the released position of the thread brake.

According to the present invention a system with a plurality of pistons is suggested so that the forces acting on the piston system are multiplied thereby ensuring a reliable opening, respectively, releasing of the thread brake when compressed air is supplied to the threading arrangement.

Description of Preferred Embodiments

The present invention will now be described in detail with the aid of several specific embodiments utilizing FIGS. 1 through 4.

The inventive two-for-one twisting spindle is comprised of a whorl 1, a turntable 2 with a thread storage disk 3, and a stationary spool pot with a supply spool 5. The spool pot 4 has a mantle portion 6, a bottom portion 7, and a hollow hub 8 shown in FIGS. 2 and 4. The spool pot 4 is provided with magnets (not represented in the drawing) which cooperate with stationary magnets arranged outside the twisting spindle for arresting the spool pot 4. The spool pot 4 is supported via bearings 9, respectively, 10, 11 (FIG. 2 and FIG. 4) at the spindle rotor 12.

Figure 2:
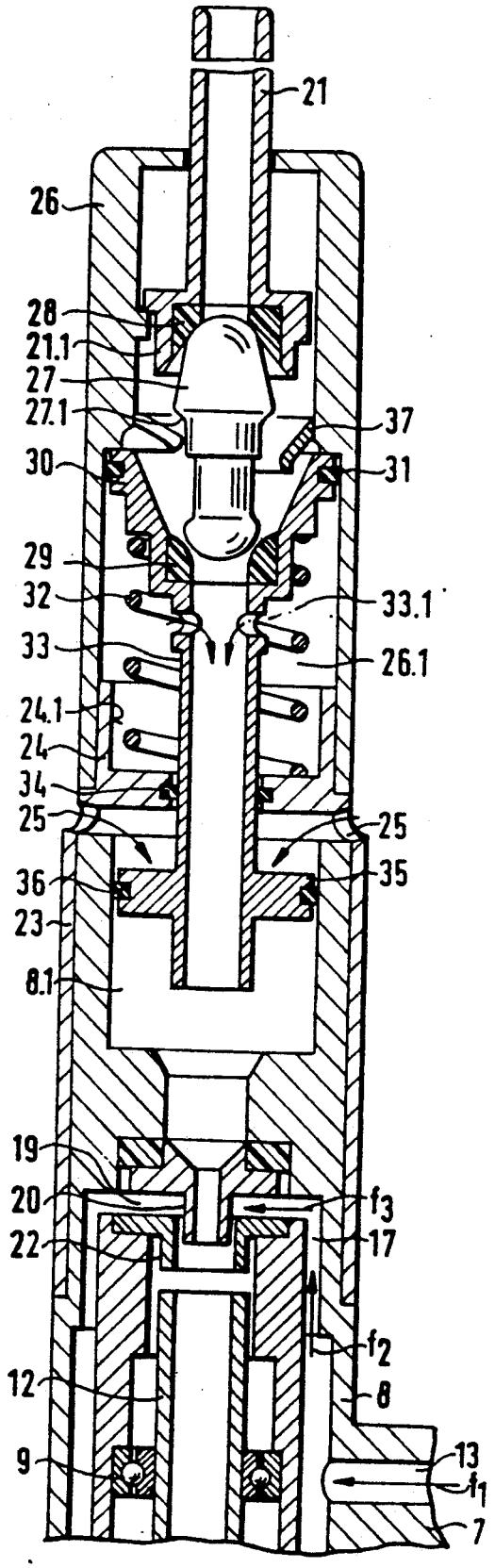
FIG. 2 is an axial cross-section of the hollow axle of the twisting spindle showing a thread brake in its braking position.

In the embodiment represented in FIG. 2, the bottom portion 7 of the spool pot 4 is provided with a radially extending segment 13 of a compressed air channel which may be connected to a compressed air connector 14 (FIG. 1) which is connected via a switching box 15 to a schematically represented compressed air source 16. The inner end of the radially extending segment 13 of the compressed air channel is connected to an annular segment 17 of the compressed air channel which extends through the hollow hub 8 of the spool pot 4 and leads to an injector nozzle 19 that is arranged above the spindle rotor 12 and is directed towards the thread storage disk 3. The injector nozzle 19 is comprised of a tube segment 22 which is centrally inserted into the hollow hub 8 of the spool pot 4 and which is connected with one end to the segment 17 of the compressed air channel and is oriented with the other end in a downward direction towards the spindle rotor 12. A socket 20 is introduced into the tube segment 22 from above thereby creating an annular slot. The socket 20 is arranged in the lower extension of the thread inlet tube 21, respectively, of the stationary portion of the hollow axle 1*a* of the twisting spindle.

The hollow hub 8 of the spool pot 4 forms a (second) cylindrical chamber 8.1 at its upper end and receives a sleeve 23, the upper end of which is closed by a face wall 24. The upper portion of the sleeve 23 is provided with lateral air inlets 25 that open into the (second) cylindrical chamber 8.1.

The face wall 24 is provided with a cylindrical bushing 24.1 which receives a cylindrical housing 26 delimiting a cylindrical chamber 26.1 that essentially forms the housing for the thread brake. The cylindrical housing 26 contains an essentially capsule-shaped braking cartridge 27 which rests at an upper stationary braking ring 28 and at a lower, axially displacable braking ring 29. The upper braking ring 28 is inserted into a cylindrical bushing 21.1 provided at the lower end of the thread inlet tube 21. The lower braking ring 29 is inserted into a stepped boring provided at the piston 30 which is axially slidable inside the (first) cylindrical chamber 26.1 and is sealing supported at the cylinder wall by a sealing ring 31. In the representation of FIG. 2, the piston 30 is shown in its initial upper position corresponding to the effective braking position of the thread brake. The piston 30 is held in this position b returning means generating the return force, for example, by a coil spring 32. This coil spring 32 is supported between the under side of the piston 30 and the upper side of the face wall 24.

A tube 33 is connected to the piston 30 extending in a downward direction as an extension of the lower braking ring 29. The tube 33 is provided with at least one lateral opening 33.1 for communicating with the (first) cylindrical chamber 26.1. The tube 33 is guided through a central opening of the face wall 24 and is sealed with a sealing ring 34. A second piston 35 is connected to the lower end of the tube 33. The second piston 35 is guided in a sealing manner in the lower (second) cylindrical chamber 8.1. The sealing effect is provided by a sealing ring 36.

When for the purpose of threading the thread through the twisting spindle the injector is supplied with compressed air in the direction of the arrows $f_1$, $f_2$, and $f_3$ via the segments 13, 17 of the compressed air channels, a vacuum, respectively, a suction effect is generated in the cylindrical chambers and channel system (comprised of the air inlets 25 and the openings 33.1) above the injector. The vacuum, respectively, suction force, which is acting, on the one hand, on the underside of the second piston 35 and, on the other hand, via the tube 33 and the lateral openings 33.1 on the underside of the first piston 30, causes the two pistons 30, 35 together with the tube 33 to be pulled in a downward direction into a position represented in FIG. 3 so that the braking cartridge 27 is released from the two braking rings 28 and 29.

Figure 3:
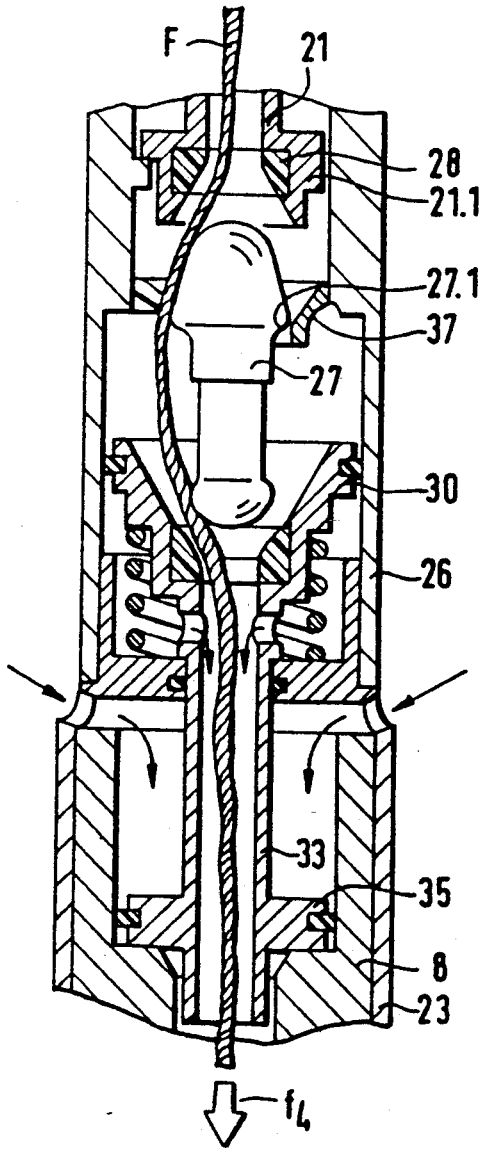
FIG. 3 shows an axial cross-section of a hollow axle of the twisting spindle with a released thread brake.

The (first) cylinder chamber 26.1 which represents the housing for the thread brake is provided with a support means for holding or catching the braking cartridge 27. Preferably, the support means is provided in the form of a ring inserted into the (first) cylindrical chamber 26.1 and comprises radially inwardly extending projections 37 which serve to catch or support a radially outwardly projecting collar 27.1 of the braking cartridge 27 when the lower braking ring 29 is displaced in a downward direction and the braking cartridge 27 falls in a downward direction due to the effect of gravity. FIG. 3 represents the opened or released position of the thread break in which a free passage for the thread F between the thread inlet tube 21 and the thread channel leading through the spindle rotor 12 towards the thread storage disk 3 so that the thread F, which is positioned at the upper end of the thread inlet tube 21, is sucked in a downward direction and is conveyed in the direction of the arrow $f_4$ through the thread guiding channel 3.1 of the thread storage disk 3 by the jet of compressed air exiting the injector nozzle 19.

When after the termination of the threading step the jet of compressed air is interrupted, the piston system and accordingly also the lower braking ring 29 is returned into the braking position represented in FIG. 2 via the return (coil) spring 32.

Figure 4:
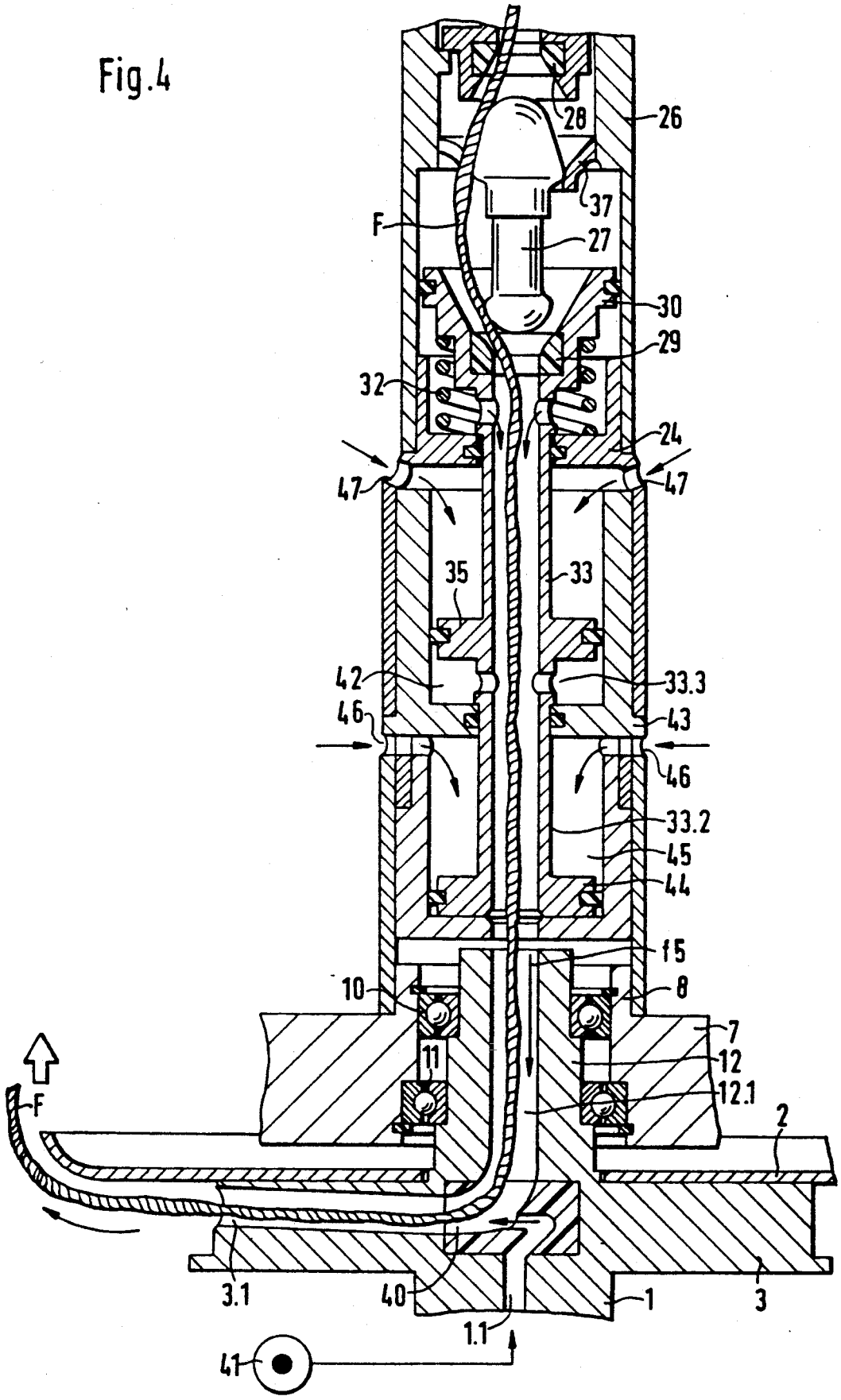
FIG. 4 is an axial cross-section of a hollow axle of another embodiment of the inventive twisting spindle showing a different thread brake and threading arrangement.

The two-for-one twisting spindle represented in FIG. 4 is provided with an injector nozzle 40 that is inserted centrally into the thread storage disk 3. This injector nozzle 40 is supplied with compressed air via a compressed air channel 1.1 from a schematically represented compressed air source 41, whereby the compressed air channel 1.1 is guided through the whorl 1. This is, for example, accomplished in the manner described in German patents 20 35 025, respectively, 30 12 427. The injector nozzle 40 is arranged such that, when supplied with compressed air, a jet of compressed air enters the radially extending thread guiding channel 3.1 of the thread storage disk 3 thereby generating, within the channel 12.1 extending in an axial direction through the spindle rotor 12, a vacuum force, respectively, suction force in the upward direction towards the thread brake and thus releasing the thread brake to the position represented in FIG. 4.

In the embodiment of FIG. 4 the piston system is in the form of a triple piston arrangement. For this purpose, a second tube 33.2 is provided which is connected with one end thereof to a free face of the second hollow piston 35 and has at least one lateral channel 33.3 for communicating with the second cylindrical chamber 42. The lateral channels 33.3 are provided below the second hollow piston 35. This second tube 33.2 is sealingly guided in the lower face wall 43 of the second cylindrical chamber 42. The second tube 33.2 is connected to a third hollow piston 44 which is sealingly slidable in a third cylindrical chamber 45. The third cylindrical chamber 45 has at least one air vent 46 in its cylindrical wall which is arranged above the third hollow piston.

The bottom of the lowest cylindrical chamber 45 is provided with a central opening in order to connect the tube 33 and the second tube 33.2 to the axial channel 12.1 of the spindle rotor 12.

For the purpose of threading a thread through the twisting spindle the injection nozzle 40 is supplied with compressed air so that a vacuum, respectively, suction force is created within the hollow axle of the twisting spindle which acts in the direction of the arrow $f_5$ and causes a downward movement of the triple piston arrangement 30, 35, 44 thereby causing the lower braking ring 29 to be moved downward also, so that a thread F may be threaded in the manner described above for FIGS. 2 and 3 through the upper end of the thread inlet tube 21 and through the hollow axle 1*a* of the twisting spindle. The triple piston arrangement is returned into the initial position together with the lower braking ring 29 via the return (coil) spring 32.

The present invention is, of course, in no way restricted to the specific disclosure of the specification and drawings, but also encompasses any modifications within the scope of the appended claims.

What I claim is:

1. A two-for-one twisting spindle in which a thread is threaded by compressed air, said two-for-one twisting spindle comprising:

a hollow axle comprising at least two cylindrical chambers;

a thread storage disk having a thread guiding channel and being connected to a lower end of said hollow axle;

a thread inlet tube connected to an upper end of said hollow axle;

a thread brake arranged inside a first one of said cylindrical chambers, said thread brake comprising a braking cartridge, an upper and a lower braking ring, and a support means for supporting said braking cartridge in a released position thereof, said braking cartridge, in a braking position, resting with an upper end at said upper braking ring and with a lower end at said lower braking ring;

a hollow piston sealingly slidable inside said first cylindrical chamber, with said lower braking ring being connected to said hollow piston;

a means for returning said hollow piston into an initial position;

a means for providing a jet of compressed air to said two-for-one twisting spindle, with said jet of compressed air generating a suction effect in said hollow axle and conveying a thread from said thread inlet tube to said thread guiding channel, the thread being forced through said guiding channel by said jet of compressed air, and with said hollow piston being axially displaceable by said suction effect against a force of said returning means thereby releasing said braking cartridge from said braking position and opening a path for the thread through said upper and lower braking rings; and at least one further hollow piston guided in a respective further one of said cylindrical chambers and being coaxial to said lower braking ring, said further hollow piston being actuatable by said jet of compressed air.

2. A two-for-one twisting spindle in which a thread is threaded by compressed air, said two-for-one twisting spindle comprising:

a hollow axle comprising at least two cylindrical chambers;

a thread storage disk having a thread guiding channel and being connected to a lower end of said hollow axle;

a thread inlet tube connected to an upper end of said hollow axle;

a thread brake arranged inside a first one of said cylindrical chambers, said thread brake comprising a braking cartridge, an upper and a lower braking ring, and a support means for supporting said braking cartridge in a released position thereof, said braking cartridge, in a braking position, resting with an upper end at said upper braking ring and with a lower end at said lower braking ring;

a hollow piston sealingly slidable inside said first cylindrical chamber, with said lower braking ring being connected to said hollow piston;

a means for returning said hollow piston into an initial position;

a means for providing a jet of compressed air to said two-for-one twisting spindle, with said jet of compressed air generating a suction effect in said hollow axle and conveying a thread from said thread inlet tube to said thread guiding channel, the thread being forced through said guiding channel by said jet of compressed air, and with said hollow piston being axially displaceable by said suction effect against a force of said returning means thereby releasing said braking cartridge from said braking position and opening a path for the thread through said upper and lower braking rings;

a tube being connected to said hollow piston and extending in a downward direction as an extension of said lower braking ring, said tube having at least one lateral opening for communicating with said first cylindrical chamber and being sealingly guided within a lower face wall of said first cylindrical chamber; and a second hollow piston connected to a free end of said tube and axially sealingly slidable inside a second one of said cylindrical chambers, said second cylindrical chamber having an air inlet in a cylindrical wall thereof arranged between said lower face wall of said first cylindrical chamber and an upper side of said second hollow piston.

3. A two-for-one twisting spindle according to claim 2, further comprising:

a second tube connected with one end thereof to a free face of said second hollow piston and sealingly guided in a lower face wall of said second cylindrical chamber, said second tube having at least one lateral channel for communicating with said second cylindrical chamber; and a third hollow piston connected to a further end of said second tube and sealingly slidable within a third one of said cylindrical chambers, said third cylindrical chamber having at least one air vent in a cylindrical wall thereof, said air vent being arranged above said third hollow piston.

4. A two-for-one twisting spindle according to claim 2, further comprising:

a spindle rotor connected to a top portion of said thread storage disk;

a spindle pot having a bottom portion with a hollow hub;

an injector nozzle connected to said means for providing said jet of compressed air and being fastened inside said hollow axle above said spindle rotor; and a compressed air channel for connecting said injector nozzle to said means for providing said jet of compressed air, said compressed air channel being comprised of a first segment extending radially through said bottom portion and a second segment extending in an axial direction through said hollow hub.

5. A two-for-one twisting spindle according to claim 2, further comprising:

an injector nozzle connected to said means for providing said jet of compressed air and being fastened centrally inside said thread storage disk, said injector nozzle having an opening directed in a direction of extension of said thread guiding channel, said thread guiding channel extending radially through said thread storage disk;

a whorl connected to a bottom portion of said thread storage spindle; and a compressed air channel for connecting said injector nozzle to said means for providing said jet of compressed air, said compressed air channel extending axially through a center of said whorl.

6. A two-for-one twisting spindle according to claim 2, wherein said support means is a ring inserted into said first cylindrical chamber and comprises radially inwardly extending projections, and wherein said braking cartridge has a radially outwardly projecting collar for cooperating with said radially inwardly extending projections in said released position.

* * * * *